US011608759B2

(12) United States Patent
Miyauchi et al.

(10) Patent No.: US 11,608,759 B2
(45) Date of Patent: Mar. 21, 2023

(54) INTERNAL COMBUSTION ENGINE

(71) Applicant: Mazda Motor Corporation, Hiroshima (JP)

(72) Inventors: Yuma Miyauchi, Aki-gun (JP); Runa Suzuki, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/724,645

(22) Filed: Apr. 20, 2022

(65) Prior Publication Data

US 2022/0381163 A1 Dec. 1, 2022

(30) Foreign Application Priority Data

May 25, 2021 (JP) ..... JP2021-087817

(51) Int. Cl.
*F01L 1/053* (2006.01)
*F01L 1/047* (2006.01)

(52) U.S. Cl.
CPC ..... *F01L 1/053* (2013.01); *F01L 2001/0475* (2013.01); *F01L 2001/0476* (2013.01); *F01L 2001/0537* (2013.01)

(58) Field of Classification Search
CPC ..... F01L 2001/0475; F01L 2001/0476; F01L 1/053; F01L 2001/0537
USPC ..... 123/90.27, 90.34
See application file for complete search history.

(56) References Cited

FOREIGN PATENT DOCUMENTS

JP 2021025653 A 2/2021

*Primary Examiner* — Jorge L Leon, Jr.
(74) *Attorney, Agent, or Firm* — Alleman Hall Creasman & Tuttle LLP

(57) ABSTRACT

An internal combustion engine includes an engine body provided with a cylinder having openings for intake and exhaust, and valve bodies that open and close the openings, cam shafts provided with cam lobes that depress the valve bodies so as to open the openings, and bearing members that pivotally supports the cam shaft via lubricating oil. Each cam shaft includes cam journals pivotally supported by the bearing members, and a hollow bore extending in the axial direction of the cam shaft. When an area of the cam journal around the hollow bore is seen in a cross-sectional view perpendicular to the axial direction, a thickness on a projecting side of the cam lobe is X1, and a thickness on the opposite side to the cam lobe in the circumferential direction is X2, a relationship of X1>X2 is satisfied in at least a part of the cam journal.

12 Claims, 14 Drawing Sheets

INTERNAL COMBUSTION ENGINE

TECHNICAL FIELD

The present disclosure relates to an internal combustion engine having a structure in which a cam journal of a cam shaft is pivotally supported by a bearing member via lubricating oil.

BACKGROUND OF THE DISCLOSURE

Internal combustion engines are provided with cam shafts which operate an intake valve for opening and closing an intake port of the cylinder, and an exhaust valve for opening and closing an exhaust port. The cam shafts are provided with a cam lobe which depresses a stem end of the intake valve or the exhaust valve, and a cam journal used as a part pivotally supported by a bearing member of a cylinder head. The cam journal is pivotally supported by a slide bearing via lubricating oil. Although it is a crank journal used as a pivotally-supported part of a crankshaft, JP2021-025653A discloses an internal combustion engine in which a plurality of recesses are provided in an outer surface of the crank journal to increase the retention of lubricating oil.

Meanwhile, in order to improve the fuel efficiency of the internal combustion engine, various kinds of mechanical losses need to be reduced. Further, in terms of suppressing friction loss of the sliding surface, it is desirable to use low-viscosity oil as the lubricating oil. However, when the low-viscosity oil is used, poor lubrication may occur in the bearing part of the cam journal, and therefore, wear may occur at the cam journal. Further, since a load is applied to the cam shaft in a direction which intersects with the axial direction when the cam lobe depresses the intake valve or the exhaust valve, a deforming force acts on the cam shaft. Therefore, the occurrence of the wear due to the deformation of the cam journal itself also poses a problem.

SUMMARY OF THE DISCLOSURE

One purpose of the present disclosure is to provide an internal combustion engine capable of suppressing wear of a cam journal accompanying a deformation of a cam shaft.

According to one aspect of the present disclosure, an internal combustion engine is provided, which includes an engine body provided with a cylinder having openings for intake and exhaust, and valve bodies that open and close the openings, cam shafts, each provided with a cam lobe that depresses the corresponding valve body to open the openings, and bearing members pivotally supporting the cam shaft via lubricating oil. Each cam shaft includes cam journals pivotally supported by the bearing members, and a hollow bore extending in the axial direction of the cam shaft. When an area of each cam journal around the hollow bore is seen in a cross-sectional view perpendicular to the axial direction, a thickness on a projecting side of the cam lobe is X1, and a thickness on the opposite side to the cam lobe in the circumferential direction is X2, a relationship of X1>X2 is satisfied in at least a part of the cam journal.

When the cam lobe depresses the valve body, the depressing load of the valve body acts on the cam shaft. The depressing load is a load in a direction which intersects with the axial direction of the cam shaft, and which deforms part of the cam lobe to the other side from the depressing direction of the valve body. The cam shaft includes the cam journal which pivotally supports the cam shaft. Thus, the deforming force resulting from the depressing load acts in such a direction that the circumferential surface of the cam journal is brought closer to the bearing member. That is, at the location opposing to the cam lobe in the circumferential direction, a state in which the circumferential surface of the cam journal is easily able to contact the bearing member is formed.

According to this configuration, as for the thickness of the area of each cam journal around the hollow bore, the thickness X2 on the opposite side to the cam lobe in the circumferential direction is set thinner than the thickness X1 on the projecting side of the cam lobe. This means that the area of the cam journal becomes more easily deformed on the opposite side of the cam lobe than the projecting side of the cam lobe. Thus, even if the cam shaft is deformed by the depressing load of the valve body, and the circumferential surface of the cam journal contacts the bearing member, the cam journal can be deformed at the part having the thin thickness X2. According to this deformation, the colliding force of the cam journal to the bearing member can be released, that is, the contact force of the cam journal with the bearing member can be eased. Therefore, the wear of the cam journal accompanying the deformation of the cam shaft can be suppressed. Even if low-viscosity oil is used as lubricating oil, it is possible to achieve both lubrication retention in the bearing member of the cam journal, and wear prevention of the cam journal.

For each cam shaft, the hollow bore may have a circular shape in the cross-sectional view perpendicular to the axial direction. The relationship of X1>X2 may be satisfied by offsetting the axial center of the hollow bore from the axial center of the cam shaft to the opposite side of the cam lobe in the circumferential direction.

According to this configuration, only by setting the axial center of the hollow bore having the circular cross-sectional shape eccentric to the axial center of the cam shaft, the cam shaft satisfying the relationship of X1>X2 can be obtained. For example, if a hollow bore having a square cross-sectional shape is formed in the cam shaft, the adjustment of the thickness around the hollow bore is not easy. However, if the cross section is circular, it can be easy to satisfy the relationship of X1>X2 and to deform the cam journal as intended at the location of the thickness X2.

The part satisfying the relationship of X1>X2 may be disposed at least at both end parts of the cam journal in the axial direction.

When the depressing load of the valve body acts on the cam shaft, at the location opposing to the cam lobe in the circumferential direction, both the axial end parts of the cam journal are deformed greatest in a direction close to the bearing member, and the deformation decreases as it goes toward the axial center. According to this configuration, the thickness distribution which matches with such a deformation mode of the cam journal can be provided, that is, both the axial end parts of the cam journal are made to be easily deformed, and thereby, the contact force of the cam journal with the bearing member can effectively be eased.

The relationship of X1>X2 may be satisfied over the full length of the cam journal in the axial direction.

According to this configuration, the cam journals are made to be easily deformed over their full length, at the opposite side of the cam lobe in the circumferential direction.

The cylinder may be one of a plurality of cylinders, each of the cylinders being provided with two openings for intake and two openings for exhaust. Each of the cam shaft for intake and the cam shaft for exhaust may include a first valve body and a second valve body that open and close the two openings for intake and the two openings for exhaust, respectively, as the valve bodies. Each cam shaft may include a first cam lobe and a second cam lobe that depress the first valve body and the second valve body, respectively. One of the cam journals may be disposed at a position between the first cam lobe and the second cam lobe.

According to this configuration, one of the cam journals is disposed at the position between the first cam lobe and the second cam lobe. Thus, when the depressing load from the first cam lobe is applied to a first axial end of the cam journal while the depressing load from the second cam lobe is applied to a second axial end, these high load parts occur at the same location in the circumferential direction of the cam journal. Therefore, as for one cam journal, the part with the thin thickness X2 for each of the first axial end and the second axial end can be formed at the same location in the circumferential direction, which makes the formation of the hollow bore to the cam shaft easy.

DETAILED DESCRIPTION OF THE DISCLOSURE

Hereinafter, an internal combustion engine according to one embodiment of the present disclosure is described in detail with reference to the accompanying drawings. In this embodiment, an engine which is mounted on a vehicle, such as an automobile, as a power source for propelling the vehicle is illustrated as one example of the internal combustion engine.

Engine Structure

Figure 1:
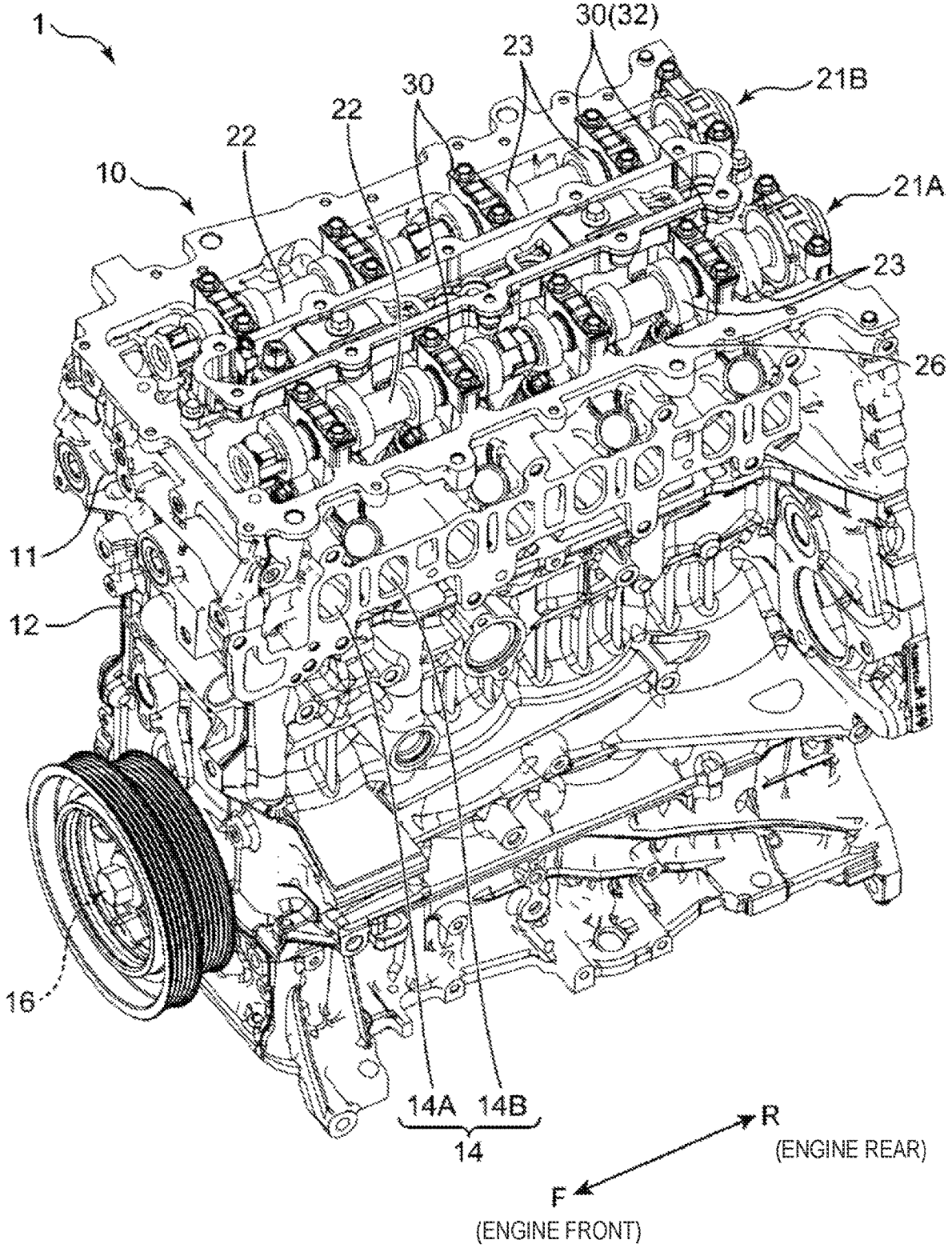
FIG. 1 is a perspective view illustrating the appearance of an engine which is one example of an internal combustion engine according to the present disclosure.
Figure 2:
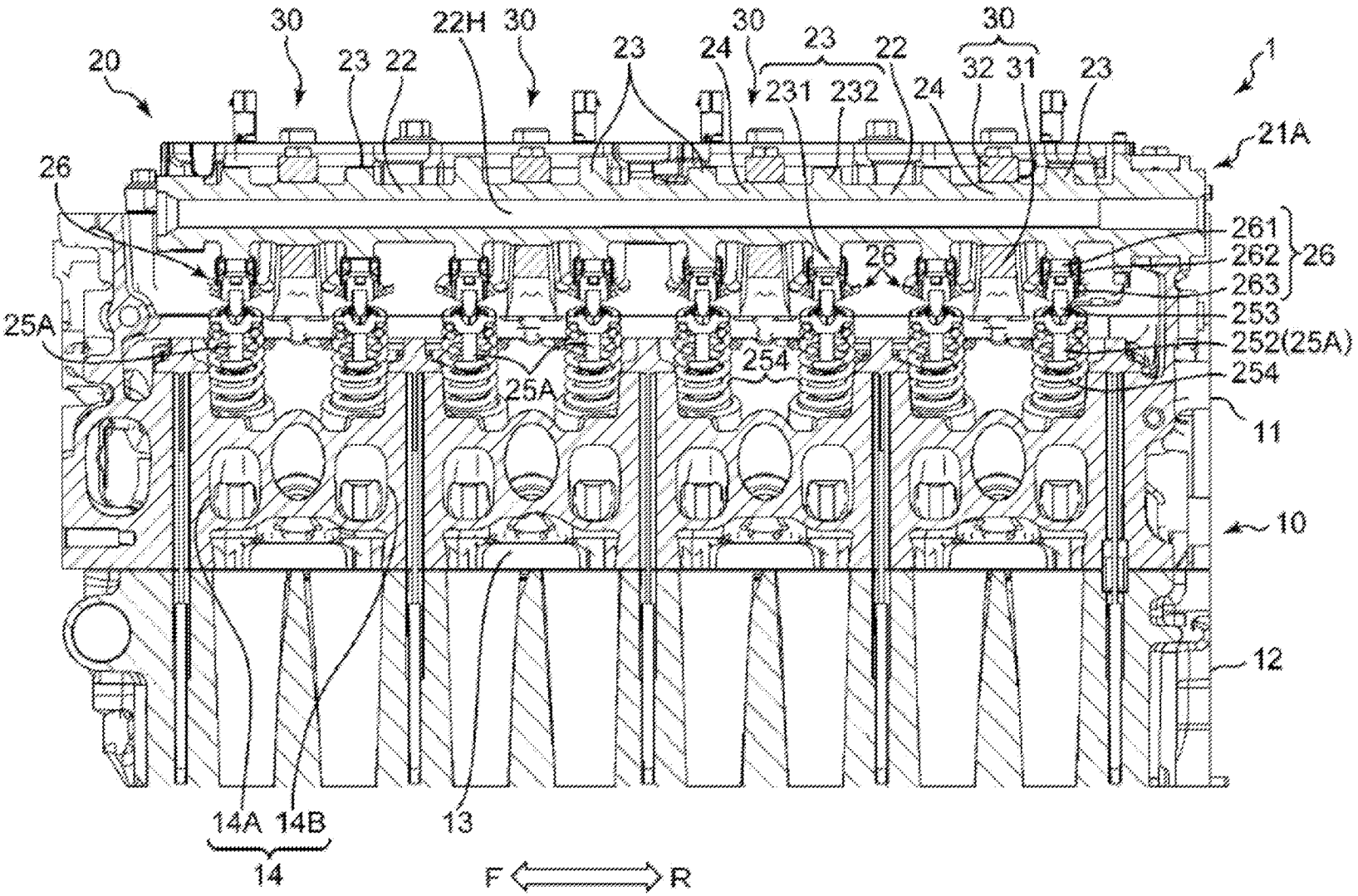
FIG. 2 is a longitudinal cross-sectional view in a cylinder lined-up direction of the engine, including a cross section of a valve operating mechanism provided to the engine.
Figure 3:
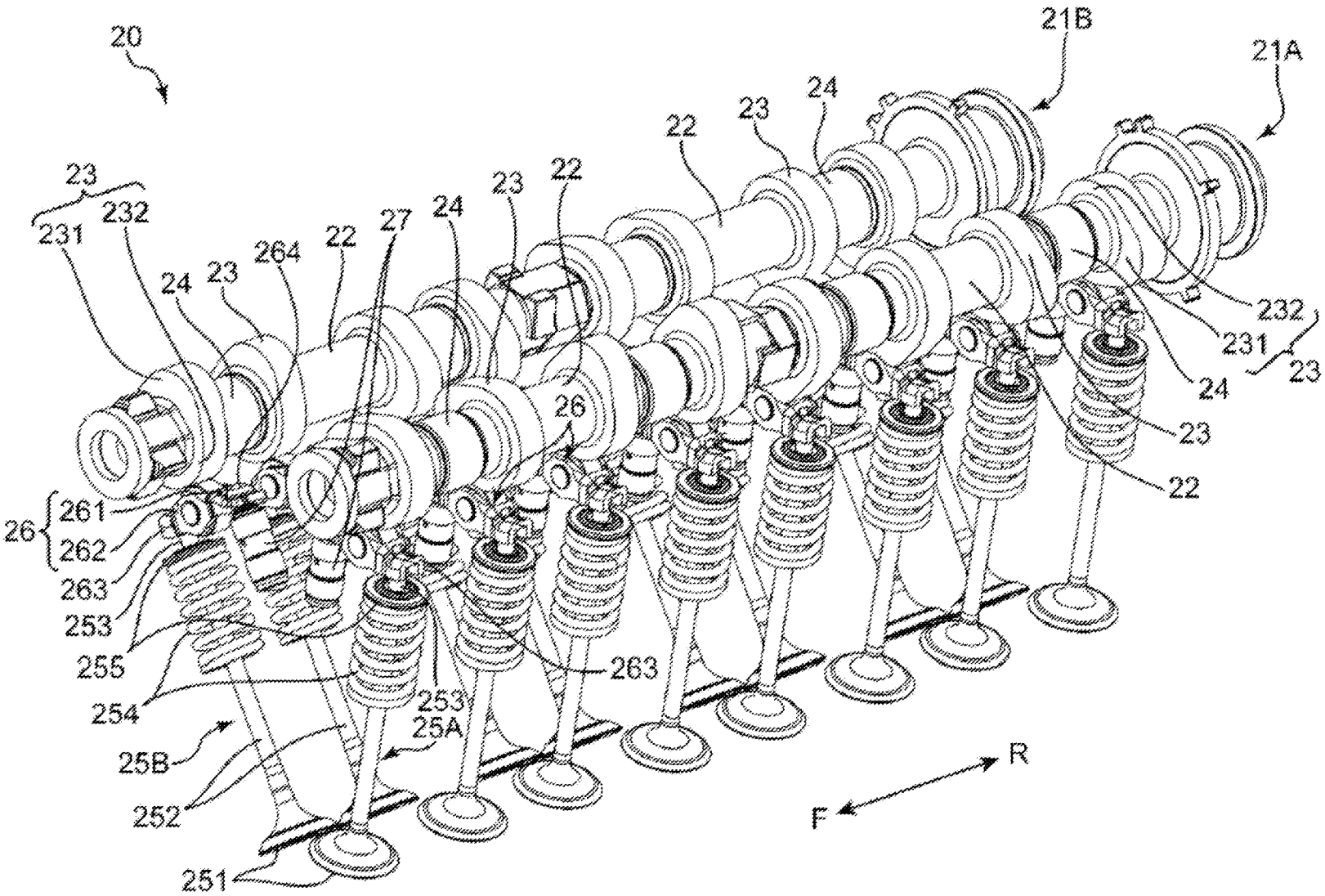
FIG. 3 is a perspective view of the valve operating mechanism.

FIG. 1 is a perspective view illustrating the appearance of an engine 1 according to this embodiment. The engine 1 is a four-stroke, in-series four-cylinder engine. In FIG. 1 and some other drawings, directional indications of "F" and "R" which respectively indicate "forward" and "rearward" of the engine 1 are given. The engine 1 includes an engine body 10, and a valve operating mechanism 20 incorporated into an upper part of the engine body 10. FIG. 2 is a longitudinal cross-sectional view in the cylinder lined-up direction of the engine 1, including a cross section of the valve operating mechanism 20. FIG. 3 is a perspective view of the valve operating mechanism 20.

The engine body 10 includes a cylinder block 11 and a cylinder head 12. The cylinder block 11 has four cylinders 13 lined up in the engine front-and-rear direction F-R (given arrangement direction). A piston is reciprocatably accommodated inside each cylinder 13. The cylinder block 11 may include more cylinders 13, and, for example, it may be for an in-series six-cylinder engine. Further, a crankshaft 16 which converts reciprocating movement of the piston into rotational movement is disposed inside a lower part of the engine body 10.

The cylinder head 12 is attached to an upper surface of the cylinder block 11, and closes an upper opening of the cylinder 13. In the cylinder head 12, intake ports 14 for taking intake air into the cylinders 13, and exhaust ports (which do not appear in FIGS. 1 and 2) are formed. Each cylinder 13 is connected to an intake system and an exhaust system in a four-valve type of two intake valves and two exhaust valves. In FIGS. 1 and 2, four pairs of intake ports 14, each pair being comprised of a first intake port 14A and a second intake port 14B, are lined up in the cylinder arrangement direction.

The cylinder head 12 is provided with intake valves 25A (valve bodies) which open and close intake ports 14, and exhaust valves 25B (valve bodies) which open and close exhaust ports. The valve operating mechanism 20 is attached to an upper surface of the cylinder head 12. A cylinder head cover (not illustrated) is attached to the upper surface of the cylinder head 12 so as to cover the valve operating mechanism 20.

The valve operating mechanism 20 is a mechanism which drives the intake valves 25A and exhaust valves 25B to open and close the intake ports 14 and the exhaust ports. The valve operating mechanism 20 drives the intake valves 25A and the exhaust valves 25B in an interlocking manner with the rotation of the crankshaft. By this drive, a valve head 251 of each intake valve 25A opens and closes a port opening 14H (see FIG. 4) of the corresponding intake port 14. Operation is similar for the exhaust valves 25B.

The intake valve 25A (the exhaust valve 25B) is a poppet type valve, and includes the valve head 251 which actually opens and closes the intake port 14 (the exhaust port), a stem 252 extending upwardly from the valve head 251, and a stem end 253 which is an upper end of the stem 252 and receives a depressing force from the valve operating mechanism 20. A valve spring 254 is fitted onto the stem 252. One end of the valve spring 254 contacts and is stopped by a spring seat 255 fixed to the stem 252.

Details of Valve Operating Mechanism

Next, the detailed structure and operation of the valve operating mechanism 20 are described. The valve operating mechanism 20 includes a cam shaft 21A for the intake valves and a cam shaft 21B for the exhaust valves, roller rocker arms 26, lash adjusters 27, and bearing members 30 which pivotally support the cam shafts 21A and 21B via lubricating oil. The cam shaft 21A for the intake valves and the cam shaft 21B for the exhaust valves are coupled to the crankshaft 16 through a chain or a belt, and are rotated on the axis in the interlocked manner with the rotation of the crankshaft 16.

The cam shaft 21A for the intake valves is disposed above eight intake valves 25A lined up in series. Similarly, the cam shaft 21B for the exhaust valves is disposed above eight exhaust valves 25B lined up in series. Each of the cam shaft 21A for the intake valves and the cam shaft 21B for the exhaust valves includes a shaft body 22, cams 23, and cam journals 24. The shaft body 22 extends straightly in the engine front-and-rear direction F-R, with a length corresponding to the arrangement length of the intake valves 25A or the exhaust valves 25B. Inside the shaft body 22, a hollow bore 22H extending in the axial direction of the cam shaft 21A or 21B is formed for the purpose of circulating cooling oil or reducing the weight. This embodiment is characterized in that the formation of the hollow bore 22H is devised, and the part of a cam journal 24 is made easily deformed. This will be described in detail later.

The cams 23 are disposed on the shaft body 22 at locations corresponding to the respectively disposed locations of the eight intake valves 25A or the eight exhaust valves 25B. Each cam 23 has a cam lobe 231 and a base circle 232. The cam lobe 231 is a major-axis part of the cam 23, and it depresses the intake valve 25A or the exhaust valve 25B via the roller rocker arm 26 to open the intake port 14 or the exhaust port. Note that the valve operating mechanism may be of a direct acting type in which the cam lobe 231 directly depresses the intake valve 25A or the exhaust valve 25B, without the intervention of the roller rocker arm 26. The base circle 232 is a minor-axis part of the cam 23, and has a larger dimension than the diameter of the shaft body 22.

The cam journal 24 is a part where the cam shaft 21A or 21B is pivotally supported by the bearing member 30. The cam journal 24 is formed slightly larger in the diameter than the shaft body 22, and is disposed at an area close to the cam 23. In this embodiment, one cam journal 24 is disposed between a pair of cams 23 disposed corresponding to one cylinder 13.

The roller rocker arm 26 is a member which transmits the depressing force of the cam 23 to the intake valve 25A or the exhaust valve 25B by utilizing the principle of leverage, and is disposed at each of the eight cams 23. The roller rocker arm 26 includes a roller 261 which contacts the circumferential surface of the cam 23, and a swing arm 262 which pivotally supports the roller 261. A contact part 263 which depresses the stem end 253 of the intake valve 25A or the exhaust valve 25B is formed at one end side of the swing arm 262. At the other end side of the swing arm 262, a pivot part 264 used as a fulcrum of the pivot of the swing arm 262 is formed.

The lash adjuster 27 automatically adjusts a valve clearance between the stem end 253 and the contact part 263. As the lash adjuster 27, a hydraulic lash adjuster utilizing oil pressure of the engine oil can be used. When the valve clearance increases due to the wear, etc., the lash adjuster 27 increases an amount of oil stored therein to reduce the valve clearance.

The bearing member 30 pivotally supports each cam journal 24 of the cam shafts 21A and 21B via lubricating oil. The bearing member 30 includes a head-side bearing 31 and a cam cap 32. The cam journal 24 is held by a pivotal support created by the engagement of the head-side bearing 31 and the cam cap 32. The head-side bearing 31 is a bearing part formed integrally with the cylinder head 12, and pivotally supports an annular circumferential surface in the lower half of the cam journal 24. The cam cap 32 is a member provided with a semicircular bearing part which pivotally supports an annular circumferential surface in the upper half of the cam journal 24, and is fixed to the head-side bearing 31 with bolts, etc. Lubricating oil is supplied between the inner circumferential surface of the head-side bearing 31 and the cam cap 32 and the outer circumferential surface of the cam journal 24. When the cam shafts 21A and 21B rotate on the axis, oil film pressure of the lubricating oil occurs, and rotation of the cam journal 24 is supported by the oil film.

Figure 4:
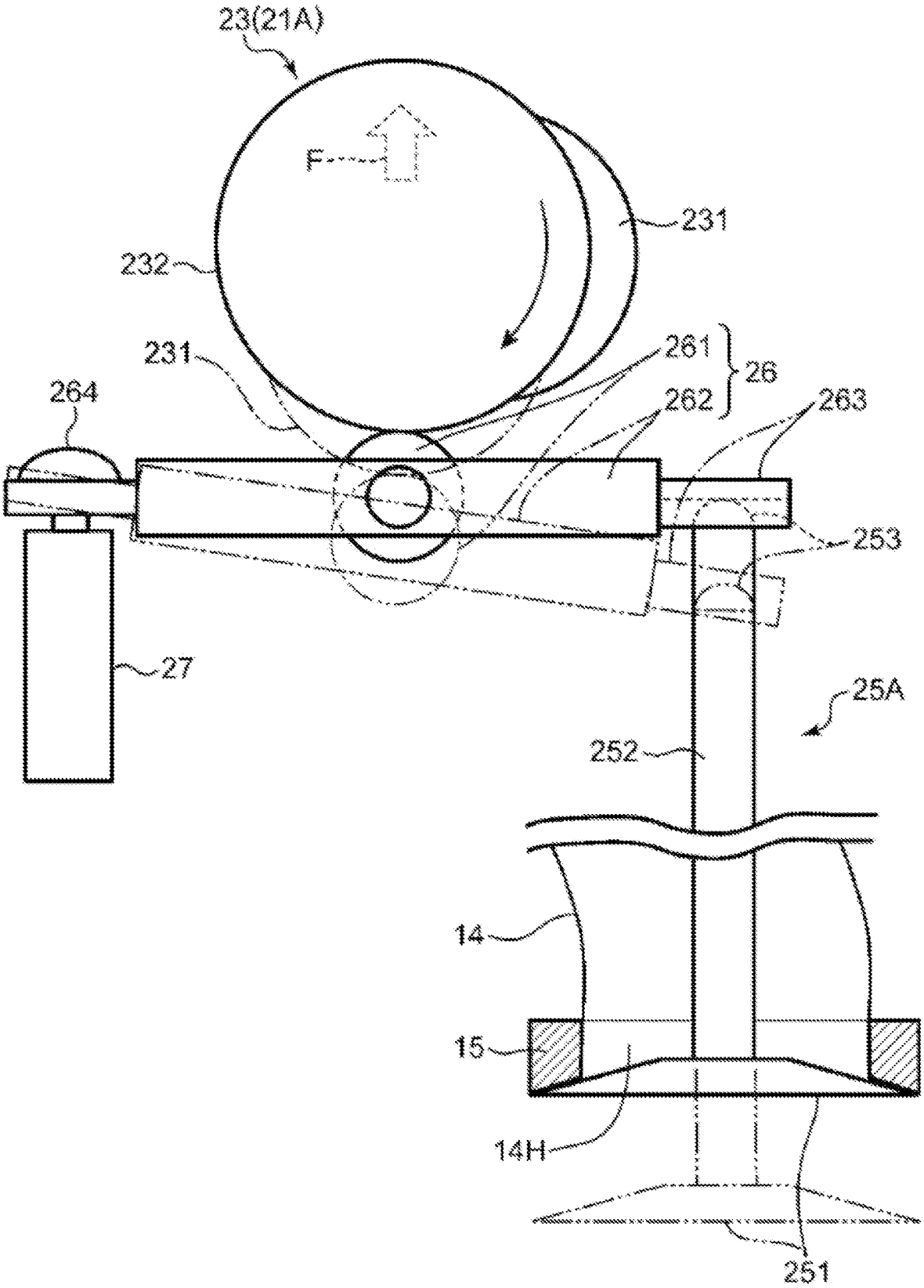
FIG. 4 is a schematic diagram illustrating a depressing operation of a valve body by a cam.

FIG. 4 is a schematic diagram illustrating a depressing operation of the intake valve 25A by the cam 23. Note that the following explanation of operation is similarly applied to the exhaust valve 25B. In FIG. 4, the circumferential surface of the cam 23 is always in contact with the circumferential surface of the roller 261 of the roller rocker arm 26 by a spring force of the valve spring 254 (not illustrated). FIG. 4 illustrates, by solid lines, a state where the base circle 232 of the cam 23 is in contact with the roller 261. In this state, the contact part 263 of the swing arm 262 does not substantially push the stem end 253 of the intake valve 25A. Therefore, the valve head 251 of the intake valve 25A is in contact with a valve seat 15, and the port opening 14H of the intake port 14 is closed.

When the cam 23 advances the rotation in the clockwise direction from the state of FIG. 4, the cam lobe 231 of the cam 23 becomes in a state of touching the roller 261, as illustrated by two-dot chain lines in this drawing. In this state, the roller 261 is pushed down by an amount of the cam lift, and the swing arm 262 inclines downwardly using the pivot part 264 as a pivot axis. By this inclination operation, the contact part 263 depresses the stem end 253 below. Therefore, the valve head 251 separates downwardly from the valve seat 15, enters into the cylinder 13, and opens the port opening 14H. Here, as illustrated by a broken-line arrow in FIG. 4, a depressing load F of the intake valve 25A acts on a position of the cam 23 which opposes to the cam lobe 231 in the circumferential direction. The depressing load F is further described.

Depressing Load of Valve Body and its Influences

Figure 5C:
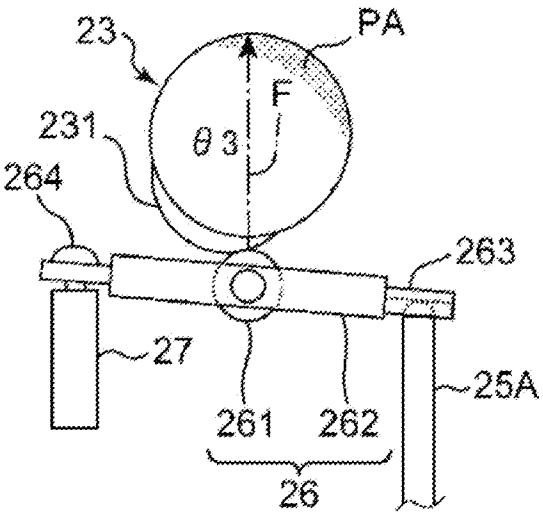
FIGS. 5A to 5C are views illustrating temporally the depressing operation of the valve body by the cam.
Figure 5B:
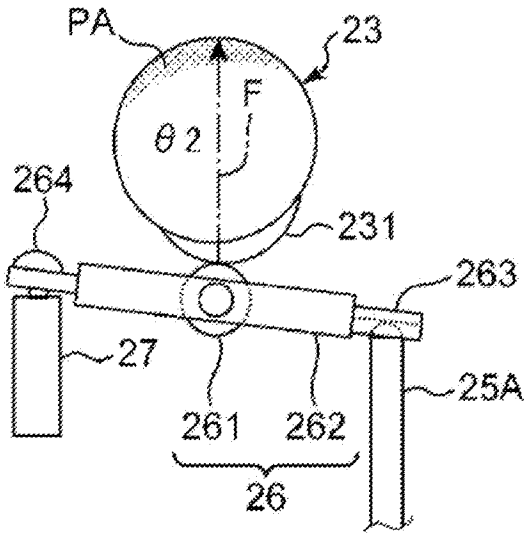
Figure 5A:
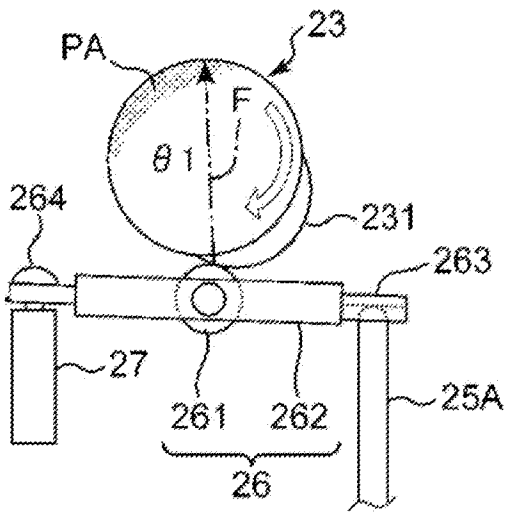
Figure 5D:
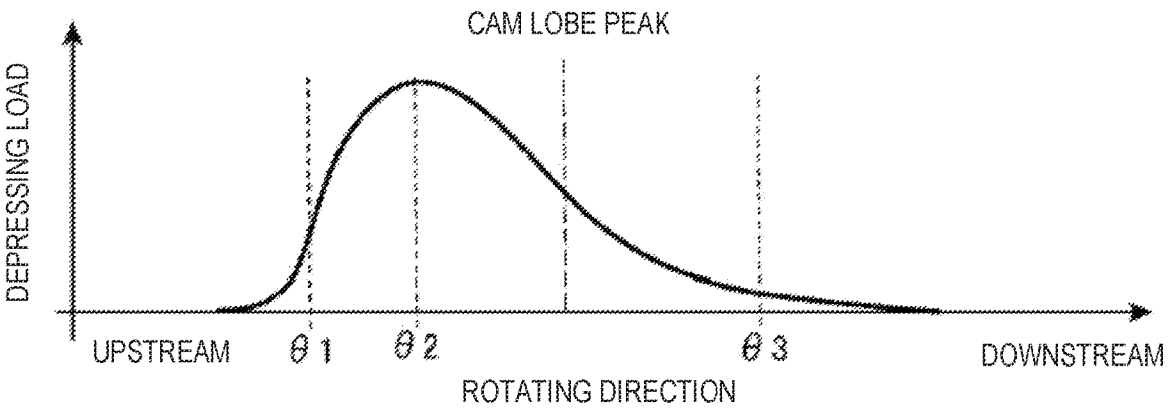
FIG. 5D is a graph illustrating a depressing load applied to the cam.

FIGS. 5A to 5C are views illustrating temporally the depressing operation of the intake valve 25A by the cam lobe 231 of the cam 23, and FIG. 5D is a graph illustrating the depressing load F applied to the cam 23. FIG. 5A illustrates a state of an early stage of the contact when the cam lobe 231 begins to contact the roller 261 (the phase of the cam shaft 21A in the rotational direction=θ1). From the contact position of the cam lobe 231 with the roller 261, the depressing load F acts toward the opposite side of the cam 23 in the radial direction. As illustrated in FIG. 5D, the early stage of contact is a period where the depressing load F becomes increases rapidly. This is because the cam 23 requires a comparatively large pressing force for starting the depression of the intake valve 25A.

FIG. 5B illustrates a state of the first half in the middle stage of contact where the contact of the cam lobe 231 with the roller 261 has progressed (the phase in the rotational direction=θ2). The swing arm 262 pivots downwardly comparatively greatly using the pivot part 264 as a pivoting fulcrum, and the contact part 263 depresses the intake valve 25A. As illustrated in FIG. 5D, this state is a state where, before the peak of the cam lobe 231 contacts the roller 261, the depressing load F is the maximum load.

FIG. 5C illustrates a state in the second half of the contact where the contact of the cam lobe 231 with the roller 261 is close to the end (the phase in the rotational direction=θ3). After the phase=θ2, the depressing load F decreases gently. After the peak of the cam lobe 231, since the intake valve 25A operates in the rising direction, the depressing load F tends to decrease more gently. When the rotation further advances and the engagement between the cam lobe 231 and the roller 261 are released, the depressing load F disappears.

FIGS. 5A to 5C each illustrates a cam high load part PA at which the depressing load F acts on the cam 23 due to the contact of the cam lobe 231 with the roller 261. The cam high load part PA occurs in the cam 23 at a location opposing to the cam lobe 231 in the circumferential direction (in other words, a location opposing to the cam lobe 231 with respect to the axial center part of the cam shaft 21A). In this drawing, the cam high load part PA is indicated by a crescent shape. This is because, in order to schematically illustrate a distribution of the depressing load F, the depressing load F is drawn thicker in the thickness in the radial direction as the depressing load F increases. Note that the cam high load part PA does not actually has the simple crescent-shaped load distribution, but it has a load distribution in which the load center of gravity is eccentric to the upstream side in the rotational direction as illustrated in FIG. 5D.

Figure 6:
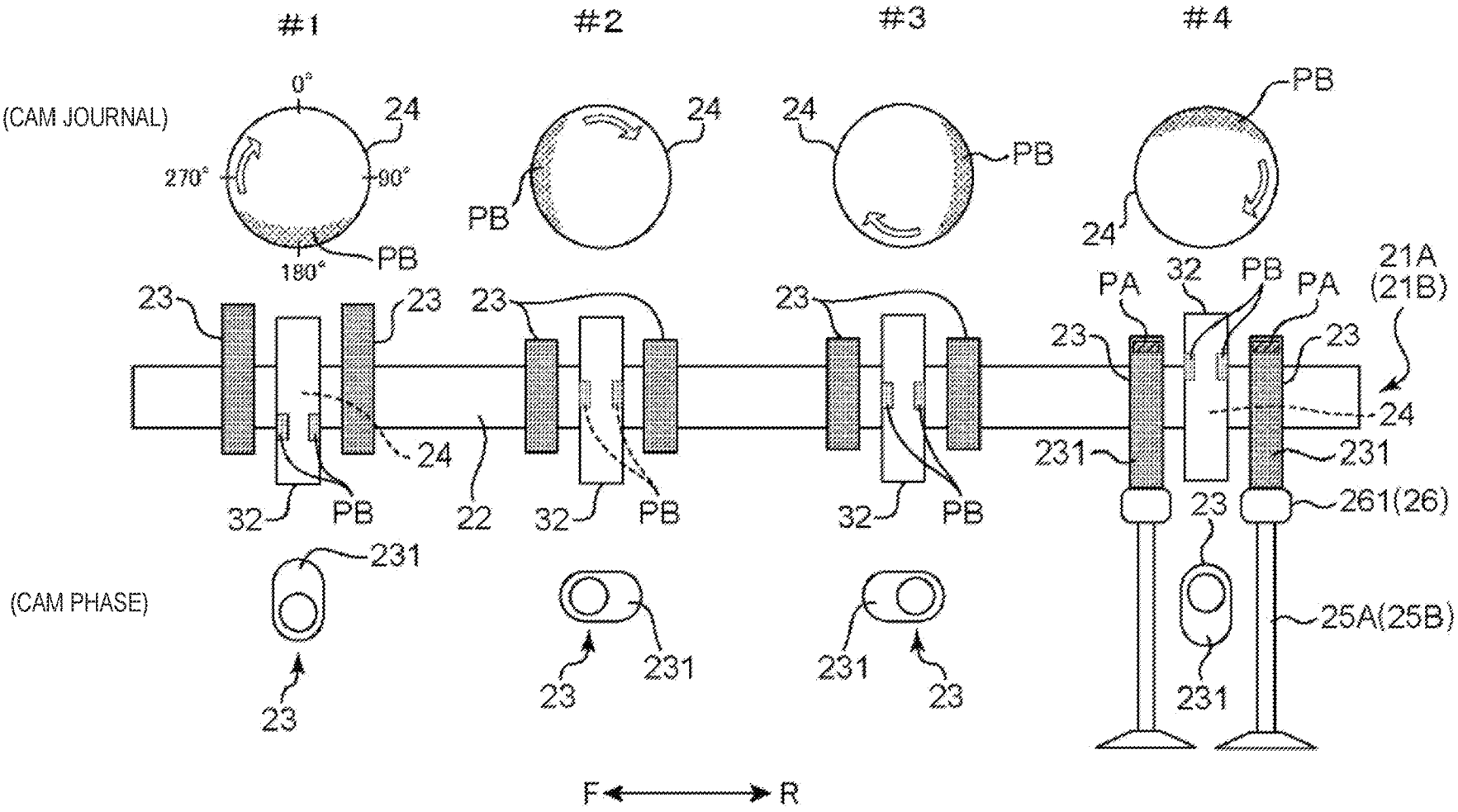
FIG. 6 is a view illustrating one example of the cam shaft, where a relationship between a rotation phase of the cam and a position of the depressing load of the valve body applied to the cam journal is illustrated.

FIG. 6 is a view schematically illustrating the cam shaft 21A for the intake valves (cam shaft 21B for exhaust valves) illustrated in FIGS. 1 to 3, where a relationship between the rotation phase of the cam 23 and the position of the depressing load of the intake valve 25A (exhaust valve 25B) applied to the cam journal 24 is illustrated. The numbers #1 to #4 in the drawing indicate the four cylinders 13 lined up in the engine front-and-rear direction F-R. As described above, in the cam shaft 21A for the intake valves, the two cams 23 are disposed for each of the #1 to #4 cylinders of four-valve type, and the cam journal 24 is disposed between the two cams 23.

As a result of having such an arrangement relationship, the cam journal 24 is disposed in an area of the shaft body 22, close to the cam 23 (cam lobe 231). Here, the "close area" is an area where the deforming force acts on the shaft body 22 due to the depressing load F received by the cam 23. For example, as illustrated in FIG. 2, the fact that the axial interval between the cam journal 24 and the cam 23 is about the axial width of one cam 23 is a typical example of the "close area."

FIG. 6 illustrates a state where the intake valves 25A corresponding to the #4 cylinder are depressed by the cam lobes 231 via the roller rocker arms 26, and the cam lobes 231 of the #1 to #3 cylinders are located at a phase where they do not engage with the rollers 261. The depressing load F actually acts on the cam 23 of the #4 cylinder, at the cam high load part PA described above. On the other hand, the depressing load F does not act on the cam high load part PA in the cam 23 of each of the #1 to #3 cylinders.

Figure 7:
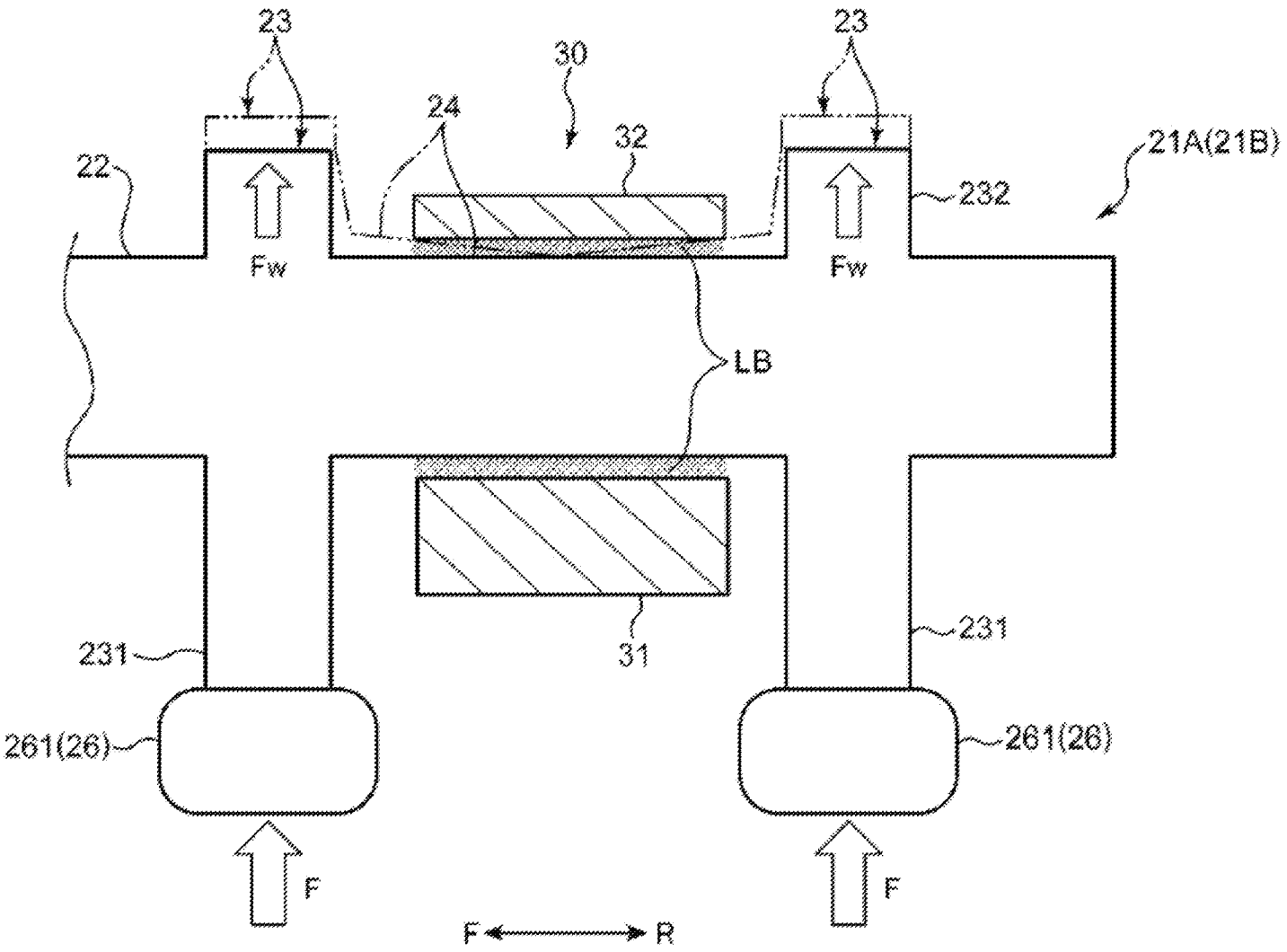
FIG. 7 is a schematic diagram illustrating a deforming situation of the cam journal when the depressing load of the valve body is applied.

When the depressing load F acts on the cam high load part PA in the cam 23, a journal high load part PB where a high load is also applied to the cam journal 24 occurs in an interlocked manner with the depressing load F. The occurring location of the journal high load part PB is a position which opposes to the cam lobe 231 in the circumferential direction, similar to the cam high load part PA. In this journal high load part PB, a deformation of the cam journal 24 originating in the depressing load F applied to the cam 23 occurs. FIG. 7 is a schematic diagram illustrating a deforming situation of the cam journal 24 when the depressing load F of the intake valve 25A is applied.

The cam journal 24 is rotatably supported by the pivotal support of the slide bearing which is created by the engagement of the head-side bearing 31 and the cam cap 32. Oil film LB of lubricating oil is formed between the inner circumferential surface of the head-side bearing 31 and the cam cap 32, and the outer circumferential surface of the cam journal 24. When the cam lobe 231 depresses the roller 261 of the roller rocker arm 26, the depressing load F acts toward the cam high load part PA which opposes to the cam lobe 231 in the circumferential direction. As illustrated by a two-dot chain line in FIG. 7, this depressing load F generates a deforming force Fw which deforms the cam shaft 21A (shaft body 22) so that the cam 23 is lifted upwardly. Note that, in FIG. 7, the deformation of the cam 23 is exaggeratingly illustrated.

Thus, when the cam 23 is deformed, the journal high load part PB occurs also in the cam journal 24 close to the cam 23, and therefore, the cam journal 24 is also deformed. In this embodiment, the cam journal 24 is disposed at the position between the pair of cams 23, and the shaft body 22 is deformed so that the pair of cams 23 are lifted upwardly. Therefore, the cam journal 24 is deformed into a bow shape so that both ends in the axial direction are raised. Such a deformation brings the outer circumferential surface the cam journal 24 near F-side and R-side end parts, close to the inner circumferential surface of the cam cap 32 which pivotally supports the annular circumferential surface of the upper half of the cam journal 24. That is, a state in which the cam journal 24 is easy to contact the cam cap 32 is formed. As for the #1 to #3 cylinders, when the phase of the cam 23 in the rotational direction becomes the same as the #4 cylinder, the deformation occurs at the journal high load part PB of the cam journal 24.

In order to suppress the mechanical resistance, it is desirable to reduce the gap between the inner circumferential surface of the head-side bearing 31 and the cam cap 32, and the cam journal 24, and to reduce the thickness of the oil film LB as much as possible. However, if the gap is reduced, the deformation of the cam journal 24 which is resulted from the depressing load F being applied to the cam 23 causes the contact of the cam journal 24 with the cam cap 32, and it invites the increase in the mechanical resistance and the stimulation of the wear, on the contrary. In consideration of this problem, in this embodiment, the cam shaft 21A (21B) is given a geometrical devise by which, even if the contact of the cam journal 24 with the cam cap 32 occurs, its impact force can be released. Below, this geometrical devise is described.

Cam Journal of this Embodiment

The cam shaft 21A (21B) of this embodiment purposely makes the journal high load part PB of the cam journal 24 easily deformed by eccentricity forming the hollow bore 22H of the shaft body 22. When the contact of the cam journal 24 with the cam cap 32 occurs, the deformation of the cam journal 24 allows the colliding force of the cam journal 24 and the cam cap 32 to escape. This avoids the increase in the mechanical resistance and the wear.

Figure 8:
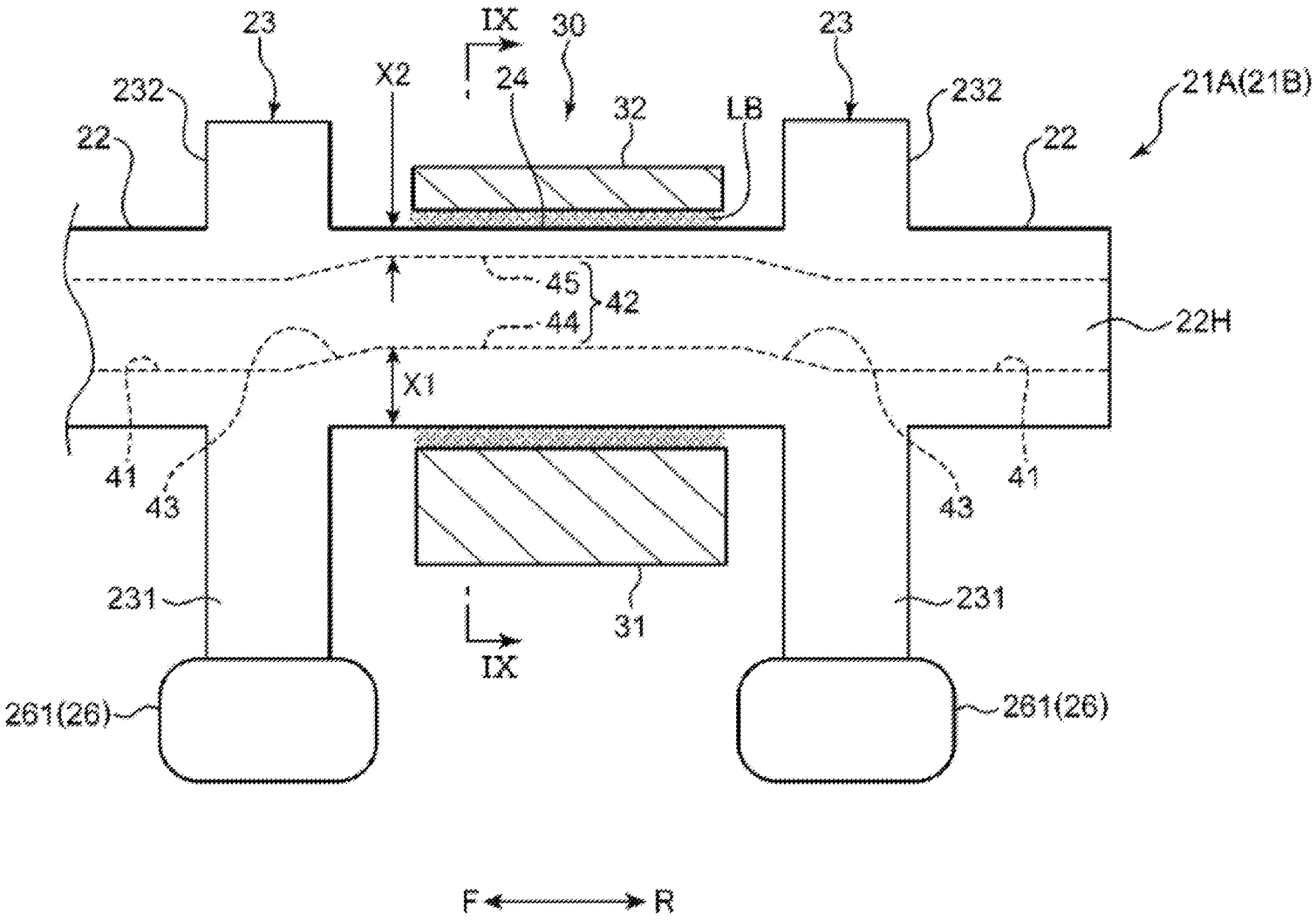
FIG. 8 is a schematic view illustrating an eccentric thickness part of a hollow bore formed in the cam journal.
Figure 9:
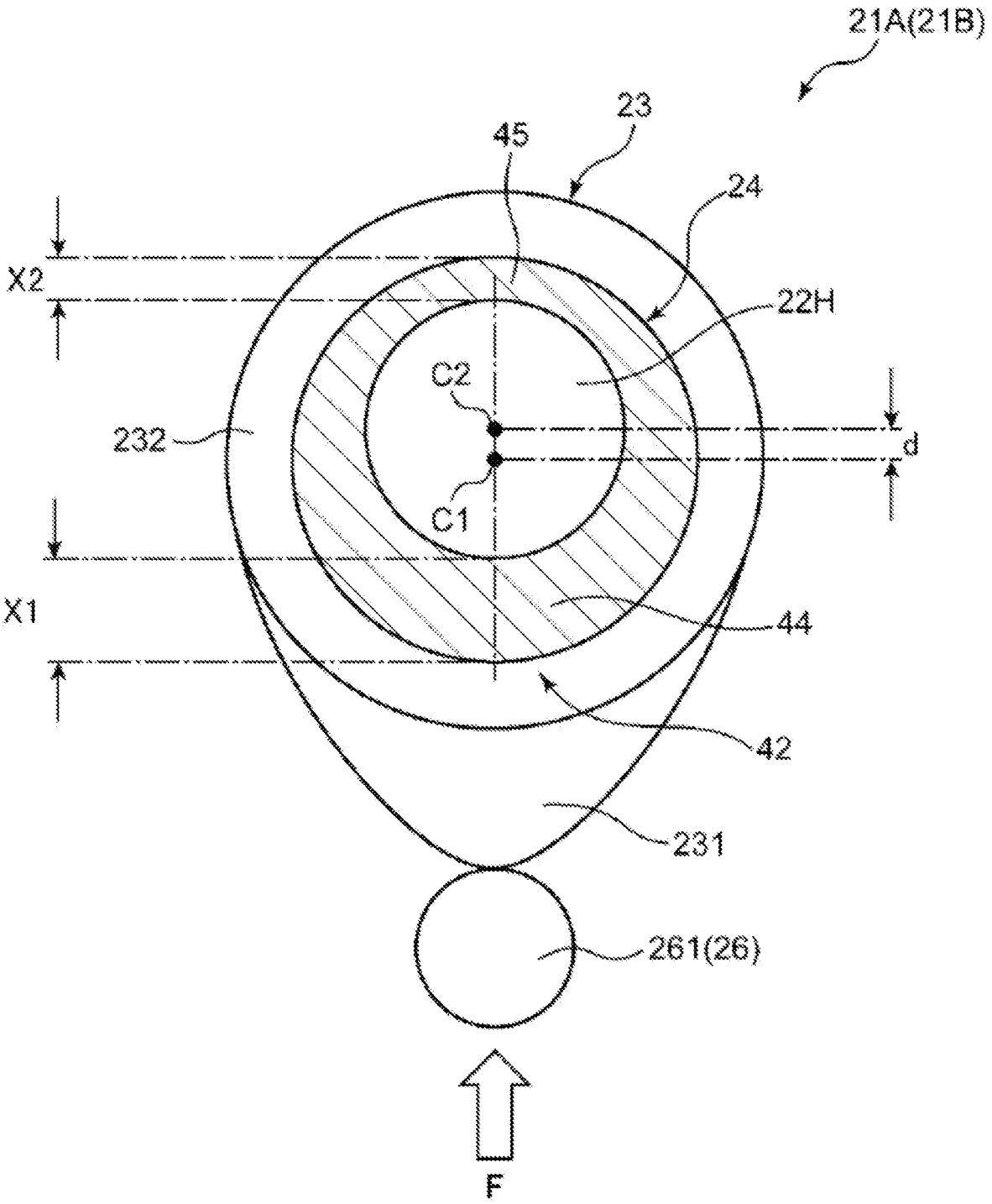
FIG. 9 is a cross-sectional view taken from a line IX-IX of FIG. 8.

FIG. 8 is a view schematically illustrating the cam shaft 21A (21B) according to this embodiment. FIG. 9 is a cross-sectional view taken from line IX-IX of FIG. 8. FIG. 8 illustrates the cam journal 24 corresponding to the #4 cylinder of FIG. 6 and its bearing member 30, the cam 23 close to the cam journal 24, and the formation of the hollow bore 22H. Also for the #1 to #3 cylinders, the hollow bore 22H is formed similarly in the journal high load part PB.

The cam journal 24 of the cam shaft 21A for the intake valves illustrated in FIG. 8 is disposed between a pair of cams 23 which depresses the intake valve 25A of the #4 cylinder. The F-side cam lobe 231 (first cam lobe) depresses the intake valve 25A (first valve body) which opens and closes the first intake port 14A (see FIG. 2), and the R-side cam lobe 231 (second cam lobe) depresses the intake valve 25A (second valve body) which opens and closes the second intake port 14B (see FIG. 2). This is similar for the cam shaft 21B for the exhaust valves. The cam journal 24 is disposed at a position close to and sandwiched between both the F-side cam lobe 231 and the R-side cam lobe 231.

In such an arrangement, the journal high load part PB occurs at the positions in the cam journal 24 which oppose to the F-side cam lobe 231 and the R-side cam lobe 231 in the circumferential direction. The hollow bore 22H formed in the cam shaft 21A is eccentricity provided so that the journal high load part PB becomes thinner. The cam shaft 21A is provided with a uniform thickness part 41, an eccentric thickness part 42, and a transition part 43 according to the formed position of the hollow bore 22H.

The uniform thickness part 41 is a part where an axial center C1 of the cam shaft 21A and an axial center C2 of the hollow bore 22H exist on the same axis. The eccentric thickness part 42 is a part where the axial center C2 of the hollow bore 22H is eccentric to the axial center C1 of the cam shaft 21A, on the opposite side of the cam lobe 231. The transition part 43 is a part which connects the hollow bore 22H of the uniform thickness part 41 and the hollow bore 22H of the eccentric thickness part 42 of which the axial centers C2 are deviated from each other. The eccentric thickness part 42 is disposed at or near the cam journal 24. The uniform thickness part 41 is disposed at the shaft body 22, other than the area of the cam journal 24.

FIG. 9 is a cross-sectional view perpendicular to the axial direction of the cam shaft 21A, where the thickness around the hollow bore 22H within the area of the cam journal 24 is illustrated. In this cross-sectional view, when the thickness on the projecting side of the cam lobe 231 is X1, and the thickness on the opposite side of the cam lobe 231 in the circumferential direction is X2, the hollow bore 22H is formed so that a relationship of X1>X2 is satisfied in the eccentric thickness part 42. That is, the eccentric thickness part 42 has a thick part 44 on the projecting side of the cam lobe 231, and a thin part 45 on the opposite side of the cam lobe 231 in the circumferential direction. The thickness around the hollow bore 22H becomes thicker gradually from the thin part 45 to the thick part 44.

The hollow bore 22H of this embodiment has a circular shape in the cross-sectional view perpendicular to the axial direction. Therefore, the eccentric thickness part 42 satisfies the relationship of X1>X2 by offsetting the axial center C2 of the hollow bore 22H from the axial center C1 of the cam shaft 21A by an eccentric length d to the opposite side of the cam lobe 231 in the circumferential direction (upward in FIG. 9). According to this embodiment, only by selecting the eccentric length d, the thickness X1 of the thick part 44 and the thickness X2 of the thin part 45 can be simply set. When the hollow bore 22H has the circular cross-sectional shape, X1:X2 can be set to about 1:0.4 to 1:0.9, for example. Note that X1 is a radial length of the thickest part in the thick part 44, and X2 is a radial length of the thinnest part in the thin part 45.

Providing the eccentric thickness part 42 as described above means that, the area of the cam journal 24 becomes easier to deform on the opposite side of the cam lobe 231 than the projecting side of the cam lobe 231. That is, the formation of the thick part 44 and the thin part 45 causes a rigidity slope in the circumferential direction of the cam journal 24 as a result. The thin part 45 becomes the easily deformed part where it is comparatively easy to deform, based on the rigid difference between the thick part 44 and the thin part 45. That is, when a high load is applied, the thin part 45 is deformed. In addition, since the thin part 45 is easy to deform, the wear of the cam journal 24 is suppressed.

Figure 10A:
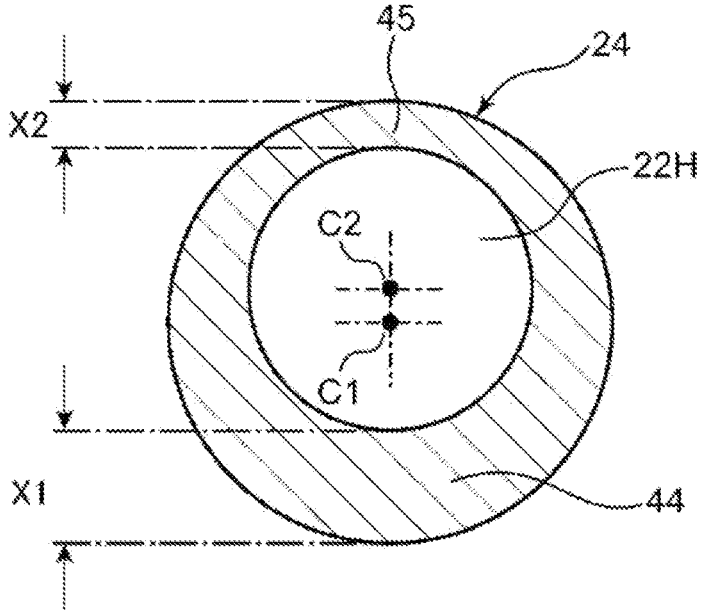
FIG. 10A is a cross-sectional view of the cam journal according to this embodiment.
Figure 10B:
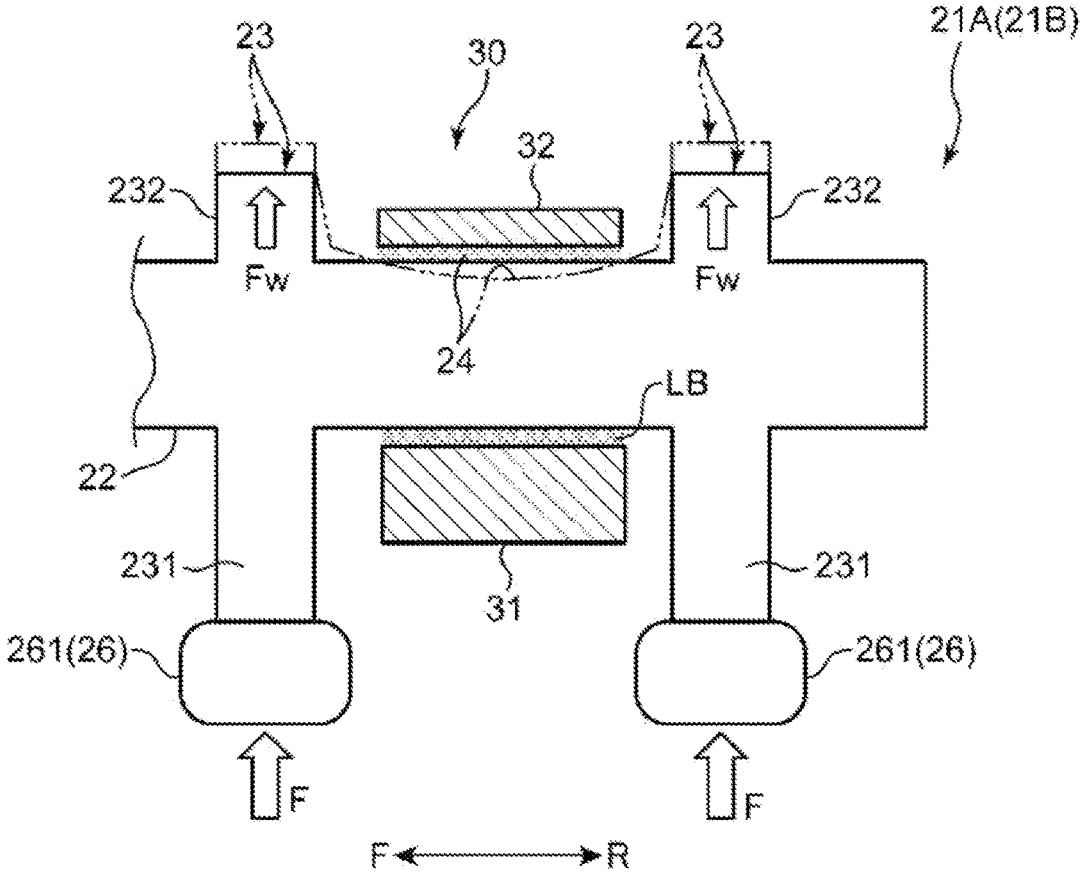
FIG. 10B is a schematic view illustrating a deformation of the cam journal.

FIG. 10A is a cross-sectional view of the cam journal 24 according to this embodiment, and FIG. 10B is a schematic view illustrating a deformation of the cam journal 24. In FIG. 10A, a cross-sectional view of the single cam journal 24 previously illustrated in FIG. 9 is illustrated. In FIG. 10B, a state where the depressing load F acts to the cam 23 by the cam lobe 231 depressing the roller 261 of the roller rocker arm 26 is illustrated. In this state, as described based on FIG. 7, a deforming force Fw which deforms the cam shaft 21A so as to lift the cam 23 upward occurs. This deforming force Fw may bring the circumferential surface of the cam journal 24 closer to (as a result, in contact with) the bearing member 30 (cam cap 32).

However, the cam journal 24 has the easily deformed thin part 45. Therefore, even if the cam shaft 21A is deformed by the depressing load F, and the circumferential surface of the cam journal 24 contacts the cam cap 32, the cam journal 24 can be deformed in the thin part 45. According to this buffering effect caused by the deformation, the colliding force of the cam journal 24 to the cam cap 32 can be released. That is, the contact force of the cam journal 24 with the cam cap 32 can be eased. Therefore, the wear of the cam journal 24 accompanying the deformation of the cam shaft 21A resulting from the depressing load F can be suppressed.

Figure 11A:
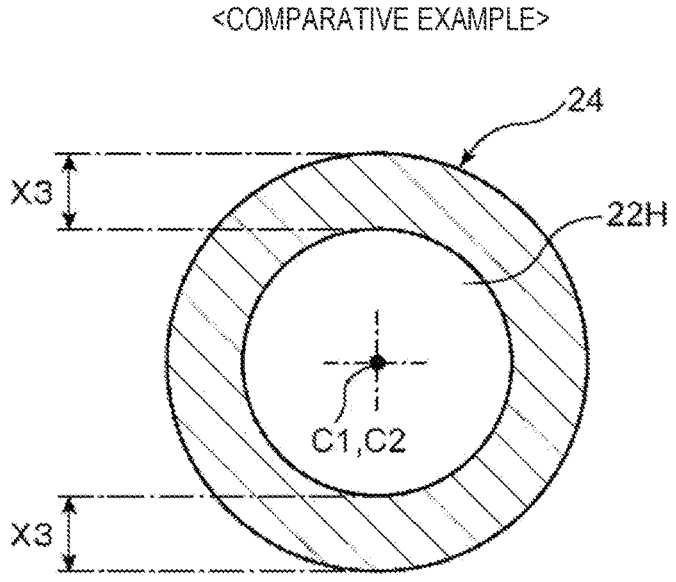
FIG. 11A is a cross-sectional view of the cam journal according to a comparative example.
Figure 11B:
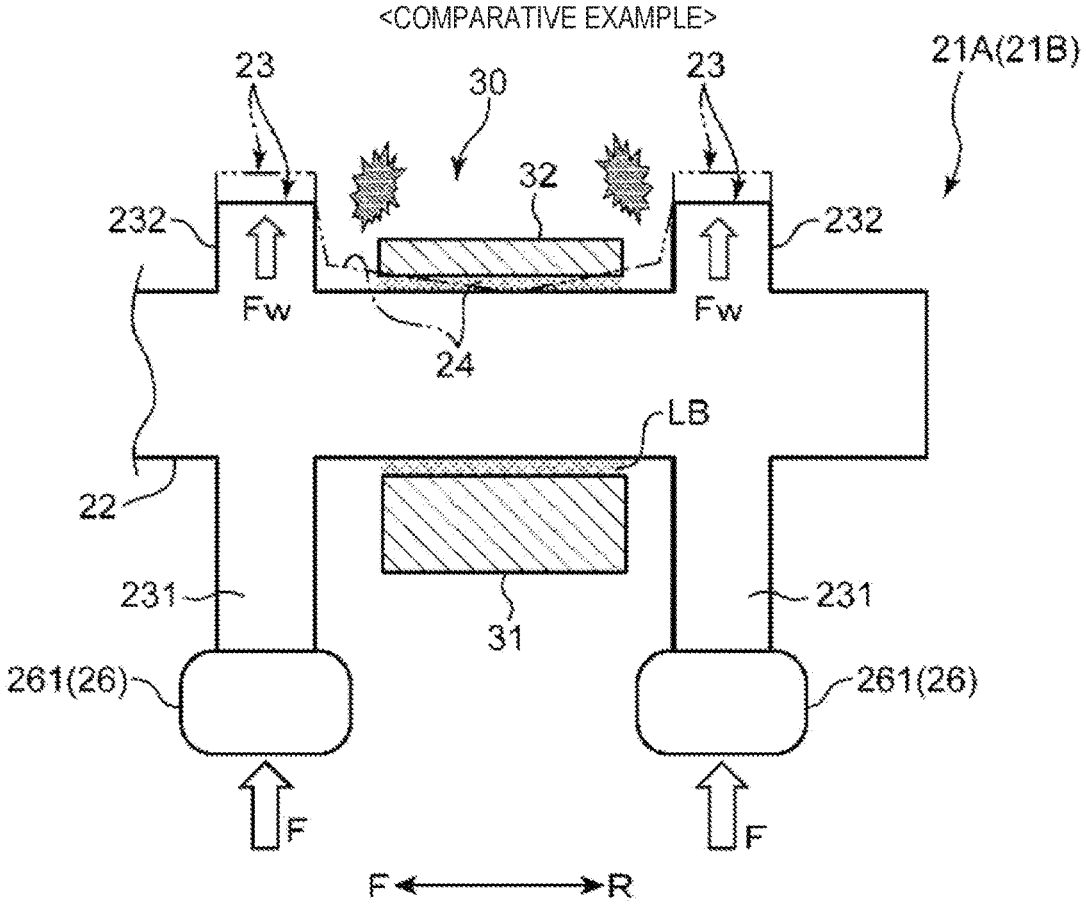
FIG. 11B is a schematic view illustrating a deformation of the cam journal.

FIG. 11A is a cross-sectional view of a cam journal 24 according to a comparative example, and FIG. 11B is a schematic view illustrating a deformation of the cam journal 24. As for the cam journal 24 of the comparative example, the thickness on the projecting side of the cam lobe 231 is X3, and the thickness on the side opposing to the cam lobe 231 in the circumferential direction is also X3. That is, the axial center C1 of the cam shaft 21A and the axial center C2 of the hollow bore 22H are located on the same axis, and the thickness around the hollow bore 22H is constant. In such a cam journal 24 of the comparative example, the rigidity slope does not occur in its circumferential direction, but the ease of deformation is constant in the circumferential direction of the cam journal 24. That is, the area which opposes the cam lobe 231 in the circumferential direction does not become an easily deformed area.

As illustrated in FIG. 11B, suppose that a depressing load F acts to the cam journal 24 of the comparative example, and a deforming force Fw occurs to deform the cam shaft 21A so as to lift the cam 23 upward. In this case, the circumferential surface of the cam journal 24 may contact the cam cap 32. However, even if the contact occurs therebetween, since the cam journal 24 of the comparative example is difficult to be deformed, the impact buffering effect will not be produced, and therefore, the circumferential surface of the cam journal 24 contacts the cam cap 32 with high rigidity. Therefore, it becomes easier to cause the wear in the cam journal 24.

Various Modes of Eccentric Thickness Part, and Arrangement

Figure 12A:
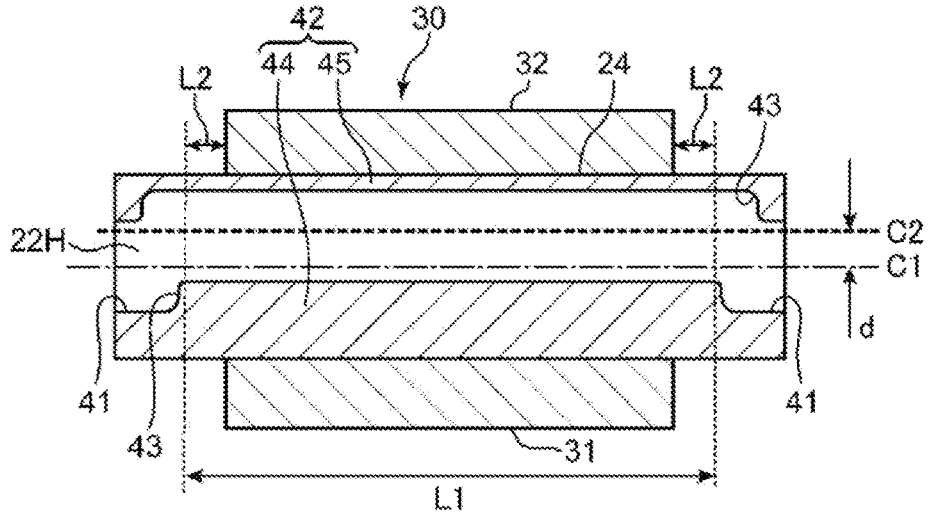
FIGS. 12A to 12C are cross-sectional views in the axial direction, illustrating various modes of the eccentric thickness part of the hollow bore formed in the cam journal.
Figure 12B:
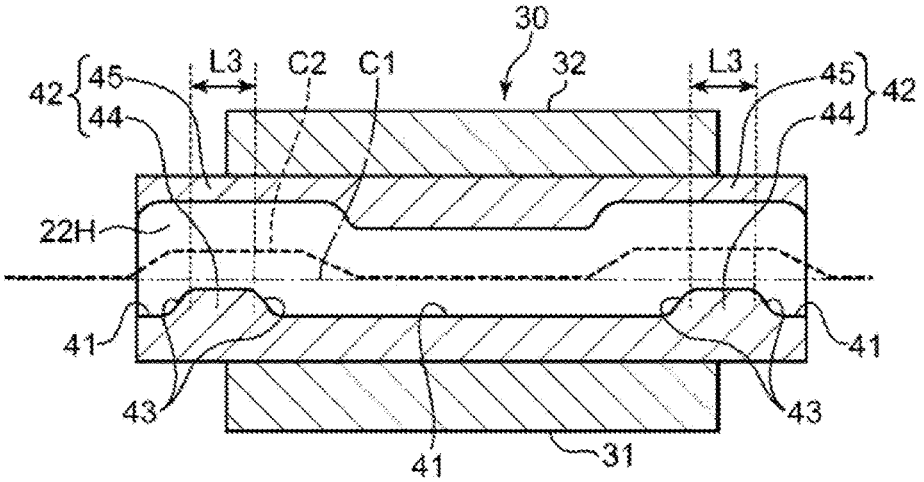
Figure 12C:
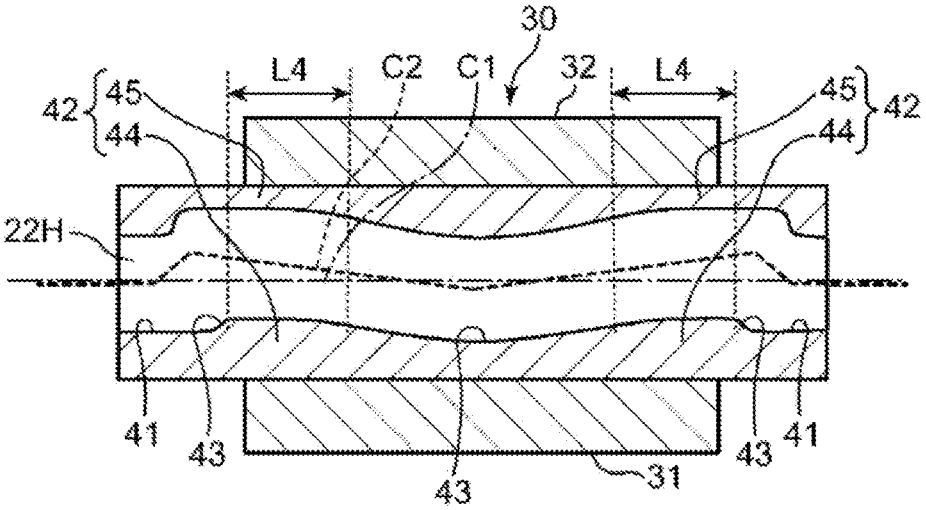

FIGS. 12A to 12C are cross-sectional views in the axial direction of the cam journal 24, illustrating various modes of the eccentric thickness part 42 in the cam journal 24. FIG. 12A illustrates one example in which the eccentric thickness part 42 which satisfies the relationship of X1>X2 is formed over the full axial length of the cam journal 24. This example is substantially the same as the eccentric thickness part 42 illustrated in FIG. 8. Each axial end part of the eccentric thickness part 42 continues to the transition part 43, and further continues to the uniform thickness part 41.

As for the eccentric thickness part 42 illustrated in FIG. 12A, the eccentric length d of the axial center C2 of the hollow bore 22H with respect to the axial center C1 of the cam shaft 21A is constant in the axial direction (constant eccentric rate) within the area of the cam journal 24. An axial length L1 of the eccentric thickness part 42 is longer than the axial width of the bearing member 30 (cam cap 32). Therefore, the eccentric thickness part 42 has a length which is extended from both the axial end parts of the bearing member 30 each by a margin L2. Because of the margins L2, the deformation of the thin part 45 is easier to occur, even when the circumferential surface of the cam journal 24 collides with the axial edge of the cam cap 32.

FIG. 12B illustrates one example in which the eccentric thickness part 42 which satisfies the relationship of X1>X2 is formed at both axial end parts of the cam journal 24. In this eccentric thickness part 42, the eccentricity of the axial center C2 of the hollow bore 22H with respect to the axial center C1 of the cam shaft 21A varies in the axial direction within the area of the cam journal 24. That is, the eccentric thickness parts 42 each having an axial length L3 disposed so as to extend across one end and the other end of the bearing member 30 in the axial direction are disposed at both axial end parts of the cam journal 24. The axial center area of the cam journal 24 is the uniform thickness part 41 in which the axial centers C1 and C2 are located on the same axis. The uniform thickness part 41 and the eccentric thickness part 42 located at each axial end part are coupled together through the transition part 43.

When the depressing load F is applied to the cam shaft 21A, at the position which opposes to the cam lobe 231 in the circumferential direction, both the axial end parts of the cam journal 24 are deformed in the direction approaching to the bearing member 30 the most, and the deformation decreases as it goes toward the axial center (see FIG. 7). That is, if the areas in both the axial end parts of the cam journal 24 are made at least to have the easily deformed nature, they can adapt for the deformation of the cam journal 24. The arrangement of the eccentric thickness parts 42 of FIG. 12B is adapted for such a deformation of the cam journal 24. That is, according to the example of FIG. 12B, both the axial end parts of the cam journal 24 are made to be easy to be deformed, and thereby, the contact force of the cam journal 24 with the cam cap 32 can effectively be eased.

The eccentric thickness part 42 illustrated in FIG. 12C is another example of varying the eccentricity of the axial center C2 of the hollow bore 22H. Similar to the eccentric thickness part 42 of FIG. 12B, the eccentric thickness parts 42 of an axial length L4 which are disposed so as to extend across one end and the other end of the bearing member 30 in the axial direction are disposed at both the axial end parts of the cam journal 24, respectively. However, it is different from the eccentric thickness part 42 of FIG. 12B in that the eccentric ratio of the thick part 44 and the thin part 45 varies gradually toward the axial center part of the cam journal 24.

Figure 13:
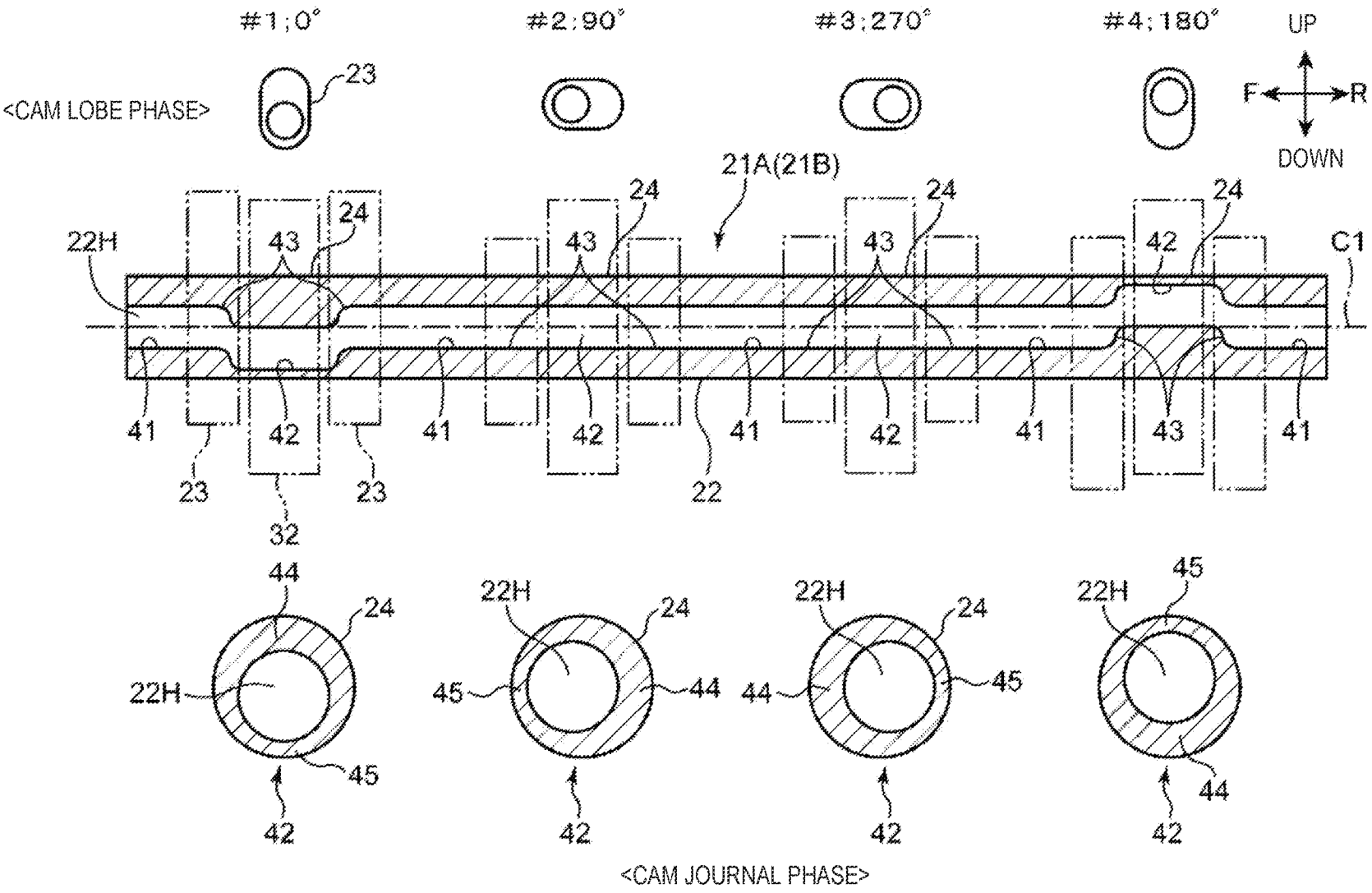
FIG. 13 is a view illustrating one example of the formation of the hollow bore over the full length of the cam shaft, and is a cross-sectional view illustrating a relationship between a rotation phase of the cam and a position of the eccentric thickness part of the hollow bore in the cam journal.

FIG. 13 is a view illustrating one example of the formation of the hollow bore 22H over the full length of the cam shaft, and is a cross-sectional view illustrating a relationship between the rotation phase of the cam 23 and the position of the eccentric thickness part 42 in the cam journal 24. In this example of the drawing, the phase of the cam 23 of the #1 cylinder in the rotational direction=0° (a state where the cam lobe 231 points upward), and the phase of the cam 23 of the #4 cylinder in the rotational direction=180° (a state where the cam lobe 231 points downward, and contacts the roller 261). In the cross section of FIG. 13, the eccentric thickness parts 42 corresponding to the #1 and #4 cylinders appear. That is, in the #1 cylinder, the eccentric thickness part 42 is offset downwardly from the axial center C1 of the cam shaft, and the thin part 45 is located below the axial center C1. On the other hand, in the #4 cylinder, the eccentric thickness part 42 is offset upwardly from the axial center C1 of the cam shaft, and the thin part 45 is located above the axial center C1.

On the contrary, in the cross section of FIG. 13, the eccentric thickness parts 42 corresponding to the #2 and #3 cylinders do not appear. Here, the phase of the cam 23 of the #2 cylinder in the rotational direction=90°, and the phase of the cam 23 of the #3 cylinder in the rotational direction=270°. The eccentric thickness parts 42 are offset in the front-and-rear direction of the drawing sheet of FIG. 13, from the axial center C1 of the cam shaft. The thin part 45 of the #2 cylinder is located rearward of the drawing sheet, and the thin part 45 of the #3 cylinder is located forward of the drawing sheet.

The hollow bore 22H in the transition parts 43 smoothly connect the hollow bores 22H of the eccentric thickness parts 42 of the #1 to #4 cylinders which are offset in different directions from the axial center C1 of the cam shaft, to the hollow bores 22H of the uniform thickness parts 41. The cross-sectional shape of the hollow bore 22H of the transition part 43 is not limited to the circular shape in order to achieve the smooth connection, but it may be a cross-sectional shape including arcs of different diameters, such as an ellipse. Such a cam shaft 21A (21B) may be manufactured, for example, by casting which uses a core.

Modifications

As described above, although the embodiments of the present disclosure are described, the present disclosure is not limited to the above embodiments, and may take the following modified embodiments.

(1) In the above embodiment, the cam shafts 21A and 21B corresponding to the in-series four-cylinder engine 1 is illustrated. The cam shafts 21A and 21B may be cam shafts for other multicylinder engines (for example, in-series six-cylinder engines).

Figure 14A:
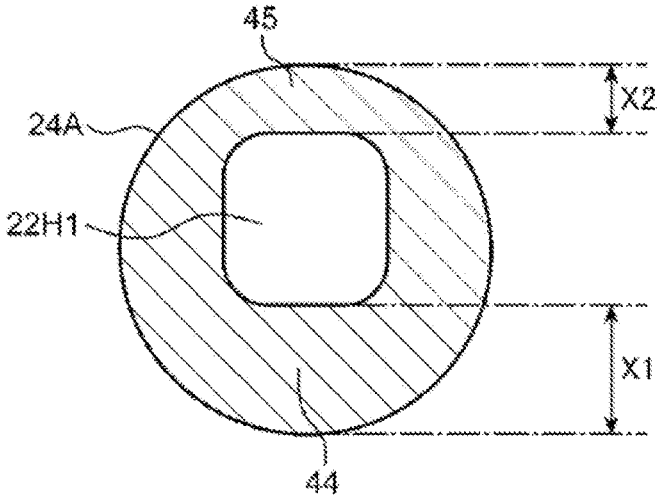
FIGS. 14A to 14C are outline cross-sectional views illustrating modifications of the hollow bore.
Figure 14B:
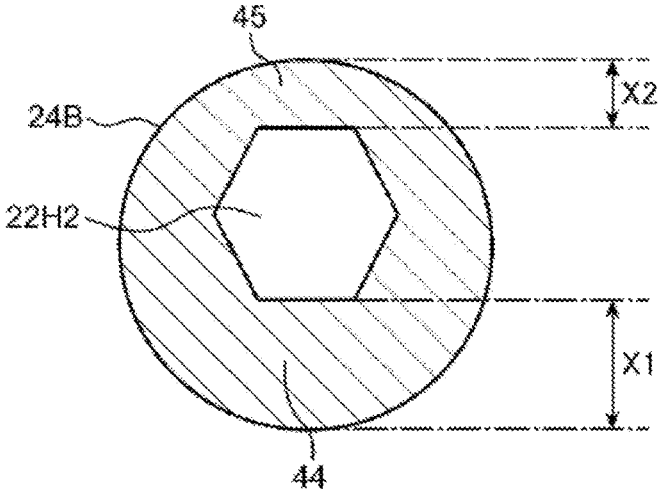
Figure 14C:
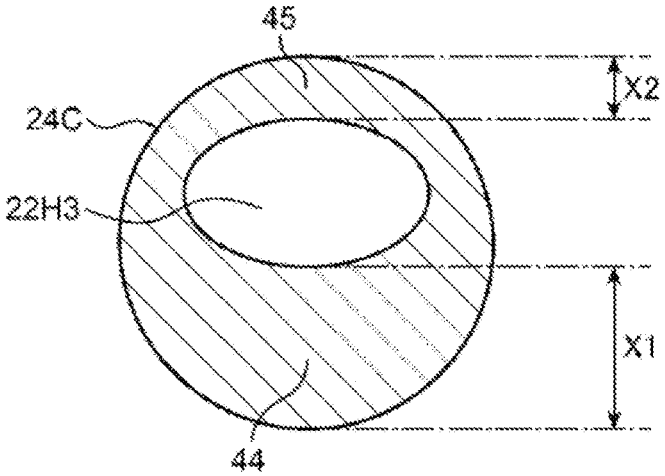

(2) In the above embodiment, as the example of the eccentric thickness part 42 in which the relationship of X1>X2 is satisfied, the example in which the axial center C2 of the hollow bore 22H having the circular cross section is offset from the axial center C1 of the cam shaft is illustrated. The hollow bore 22H is not limited to have the circular cross-sectional shape. FIGS. 14A to 14C illustrate cam journals 24A, 24B, and 24C respectively provided with hollow bores 22H1, 22H2, and 22H3 according to modifications.

FIG. 14A is a cross-sectional view illustrating a cam journal 24A with the hollow bore 22H1 having a substantially square cross-sectional shape. The hollow bore 22H1 is disposed so as to be eccentric upward from the axial center C1 of the cam shaft. Therefore, the cam journal 24A has the thick part 44 and the thin part 45 to achieve such a relationship that the thickness X1 on the projecting side of the cam lobe 231 is larger than the thickness X2 on the opposite side of the cam lobe 231 in the circumferential direction.

FIG. 14B is a cross-sectional view illustrating a cam journal 24B with the hollow bore 22H2 having a hexagonal cross-sectional shape. In this example, the relationship of X1>X2 is also satisfied by the eccentric arrangement of the hollow bore 22H2. FIG. 14C is a cross-sectional view illustrating a cam journal 24C with the hollow bore 22H3 having the elliptical cross-sectional shape. The relationship of X1>X2 is satisfied by the eccentric arrangement of the hollow bore 22H3, as well as orientating the direction of the minor axis of the ellipse to the same direction as the projecting direction of the cam lobe 231. Such hollow bores 22H1, 22H2, and 22H3 can also cause the deformation of the cam journals 24A, 24B, and 24C in the thin part 45 according to the depressing load F.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine (Internal Combustion Engine)
10 Engine Body
13 Cylinder
14 Intake Port
14H Port Opening (Opening for Intake and Exhaust)
21A Cam Shaft for Intake Valve (Cam Shaft)
21B Cam Shaft for Exhaust Valve (Cam Shaft)
22 Shaft Body
22H Hollow Bore
23 Cam
231 Cam Lobe
24 Cam Journal
25A, 25B Intake Valve, Exhaust Valve (Valve Body)
30 Bearing Member
31 Head-side Bearing
32 Cam Cap (Bearing Member)
41 Uniform Thickness Part
42 Eccentric Thickness Part
43 Transition Part
44 Thick Part
45 Thin Part
C1 Axial Center of Cam Shaft
C2 Axial Center of Hollow Bore
X1 Thickness of Thick Part
X2 Thickness of Thin Part

What is claimed is:

1. An internal combustion engine, comprising:

an engine body defining at least one cylinder including at least one intake opening, at least one exhaust opening, and a plurality of valve bodies, each opening configured to be opened and closed via an associated valve body of the plurality of valve bodies;

an intake cam shaft including at least one intake cam lobe corresponding to the at least one intake opening, each intake cam lobe configured to open the corresponding intake opening by depressing the associated valve body; and an exhaust cam shaft including at least one exhaust cam lobe corresponding to the at least one exhaust opening, each exhaust cam lobe configured to open the corresponding exhaust opening by depressing the associated valve body, wherein each cam shaft further includes:

a plurality of cam journals corresponding to a plurality of bearing members, each cam journal configured to be pivotally supported by the corresponding bearing member via lubricating oil, and a hollow bore extending along a central axis of the cam shaft, wherein each cam journal is adjacent to a corresponding cam lobe of the at least one intake cam lobe or the at least one exhaust cam lobe, and wherein, at least partially through each cam journal, a central axis of the hollow bore is offset from the central axis of the cam shaft such that a thickness of an inner wall of the cam shaft on a projecting side of the corresponding cam lobe is greater than a thickness of the inner wall on a side diametrically opposed to the projecting side.

2. The internal combustion engine of claim 1, wherein the hollow bore of each cam shaft has a circular cross-sectional shape.

3. The internal combustion engine of claim 2, wherein, in each cam journal, the offset of the central axis of the hollow bore is disposed at least at axial end parts of the cam journal.

4. The internal combustion engine of claim 3, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

5. The internal combustion engine of claim 2, wherein, in each cam journal, the offset of the central axis of the hollow bore extends through a full axial length of the cam journal.

6. The internal combustion engine of claim 5, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

7. The internal combustion engine of claim 2, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

8. The internal combustion engine of claim 1, wherein, in each cam journal, the offset of the central axis of the hollow bore is disposed at least at axial end parts of the cam journal.

9. The internal combustion engine of claim 8, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

10. The internal combustion engine of claim 1, wherein, in each cam journal, the offset of the central axis of the hollow bore extends through a full axial length of the cam journal.

11. The internal combustion engine of claim 10, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

12. The internal combustion engine of claim 1, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

* * * * *